US008899672B2

(12) United States Patent
Li

(10) Patent No.: US 8,899,672 B2
(45) Date of Patent: Dec. 2, 2014

(54) LINKAGE FOR A FOLDABLE HIGH CHAIR

(71) Applicant: Lerado (Zhong Shan) Industrial Co., Ltd., Zhong Shan, Guang Dong Province (CN)

(72) Inventor: Wei-Yeh Li, Tainan (TW)

(73) Assignee: Lerado (Zhong Shan) Industrial Co., Ltd., Zhong Shan, Guang Dong Province (CN)

( * ) Notice: Subject to any disclaimer, the term of this patent is extended or adjusted under 35 U.S.C. 154(b) by 0 days.

(21) Appl. No.: 14/024,002

(22) Filed: Sep. 11, 2013

(65) Prior Publication Data

US 2014/0070574 A1 Mar. 13, 2014

(30) Foreign Application Priority Data

Sep. 11, 2012 (CN) ..... 2012 2 0459654 U

(51) Int. Cl.

| | |
|---|---|
| ***A47D 1/02*** | (2006.01) |
| ***A47B 83/02*** | (2006.01) |
| ***A47D 1/00*** | (2006.01) |

(52) U.S. Cl.

CPC . *A47D 1/02* (2013.01); *A47D 1/002* (2013.01)

USPC ..... 297/38; 297/53; 297/153

(58) Field of Classification Search

USPC ..... 297/16.1, 35, 38, 40, 53, 153

See application file for complete search history.

(56) References Cited

U.S. PATENT DOCUMENTS

| | | | | |
|---|---|---|---|---|
| 3,012,815 | A * | 12/1961 | Smith | 297/40 |
| 3,147,036 | A * | 9/1964 | McRae | 297/56 |
| 7,628,450 | B2 * | 12/2009 | Castagnola et al. | 297/38 |
| 7,703,843 | B2 * | 4/2010 | Chen et al. | 297/41 |

* cited by examiner

*Primary Examiner* — Milton Nelson, Jr.

(74) *Attorney, Agent, or Firm* — Muncy, Geissler, Olds & Lowe, P.C.

(57) ABSTRACT

A linkage for a foldable high chair comprises at least a front strut frame, a rear strut frame, a chair back frame, a seat support frame, a pair of arm rests, a first link, a second link and third link assembled by pivoting with each other and a locking mechanism for keeping the foldable high chair in a use position. The seat support frame is driven by the chair back frame and drives the first slidable connector through the first link and the third link, and then the first slidable connector may drive the rear strut frame through the second link, thereby rotating the rear strut frame to the front strut frame.

10 Claims, 6 Drawing Sheets

LINKAGE FOR A FOLDABLE HIGH CHAIR

BACKGROUND OF THE INVENTION

1. Field of the Invention

The present invention relates to a linkage of a high chair, especially to a high chair is foldable by merely rotating the chair back frame forward and downward.

2. Description of the Related Art

To erect a traditional foldable high chair from its folded position, the user may always need to bend down himself to hold the front strut frame and the rear strut frame at the same time, and then rotate both of the front strut frame and the rear strut frame in opposite directions. It is troublesome and inconvenient for the user.

SUMMARY OF THE INVENTION

For eliminating the trouble and inconvenience for the user, the present invention provides a linkage for a foldable high chair, which is capable of keeping in a use position by a locking mechanism, and then can be folded by the rotation of its chair back frame forward and downward.

The front strut frame of the foldable high chair has an upper end provided with a first pivotable portion for pivoting with a chair back frame, a second pivotable portion for pivoting with a rear strut frame, and a third pivotable portion for pivoting with a first link.

The foldable high chair further includes a first slidable connector sleeved on and slidable along the front strut frame, a second link having one end pivoted with the rear strut frame, and another end pivoted with the first slidable connector, and a third link having an upper end pivoted with the first link and a lower end pivoted with the first slidable connector. The foldable high chair further includes a seat support frame to pivot between the chair back frame and the first link, and two second slidable connectors which slidably connected to the pair of arm rests and pivoted with the first link.

By this linking arrangement, the seat support frame is capable of driving by the chair back frame and then drives the first slidable connector through the first link and the third link, and then the first slidable connector drives the rear strut frame through the second link, thereby rotating the rear strut frame to the front strut frame, i.e. the foldable high chair is foldable by unlocking the locking mechanism and then rotating the chair back frame forward and downward thereby folding the foldable high chair into a folded position.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
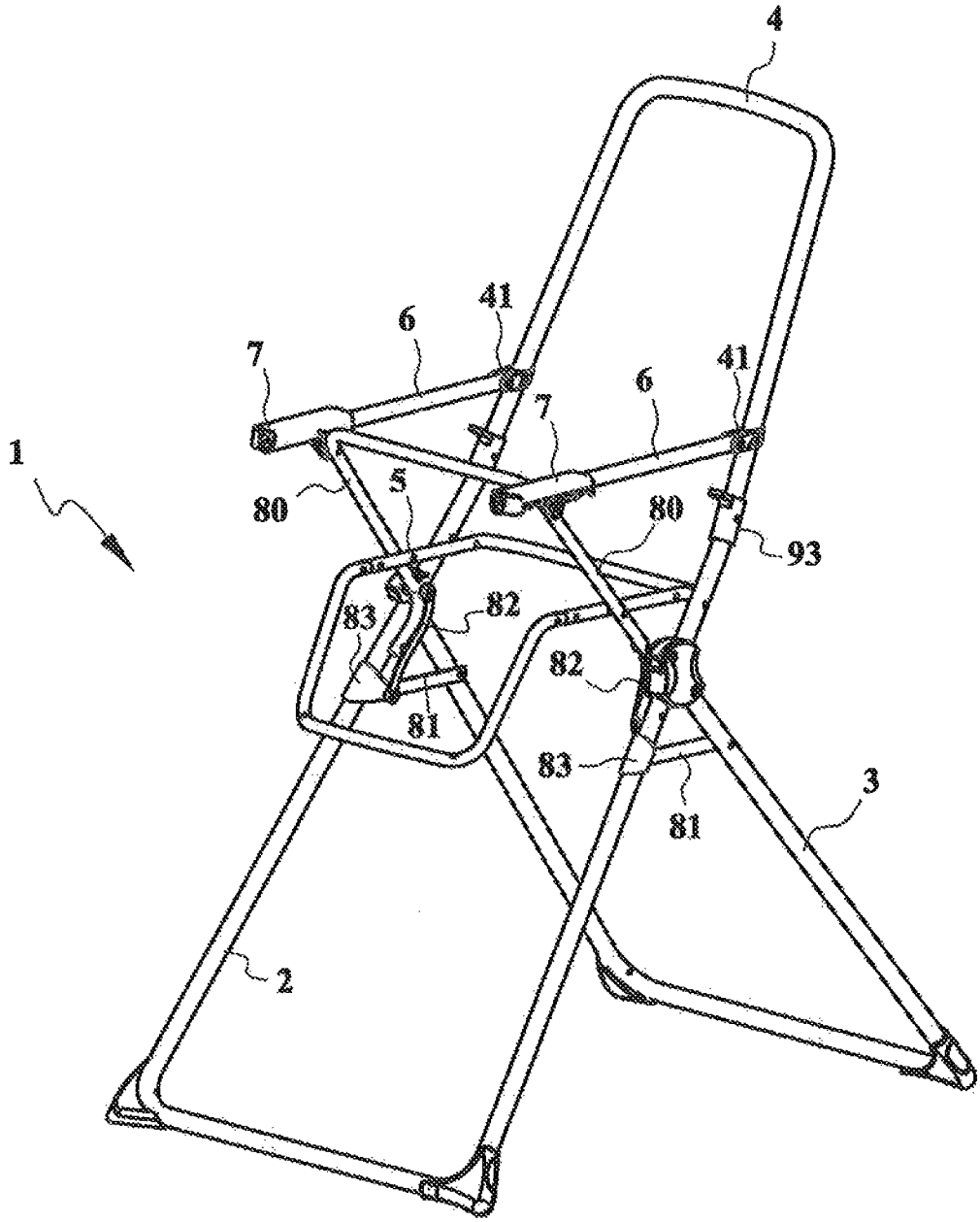
FIG. 1 is a front and left perspective view of the linkage for a foldable high chair according to the present invention.
Figure 2:
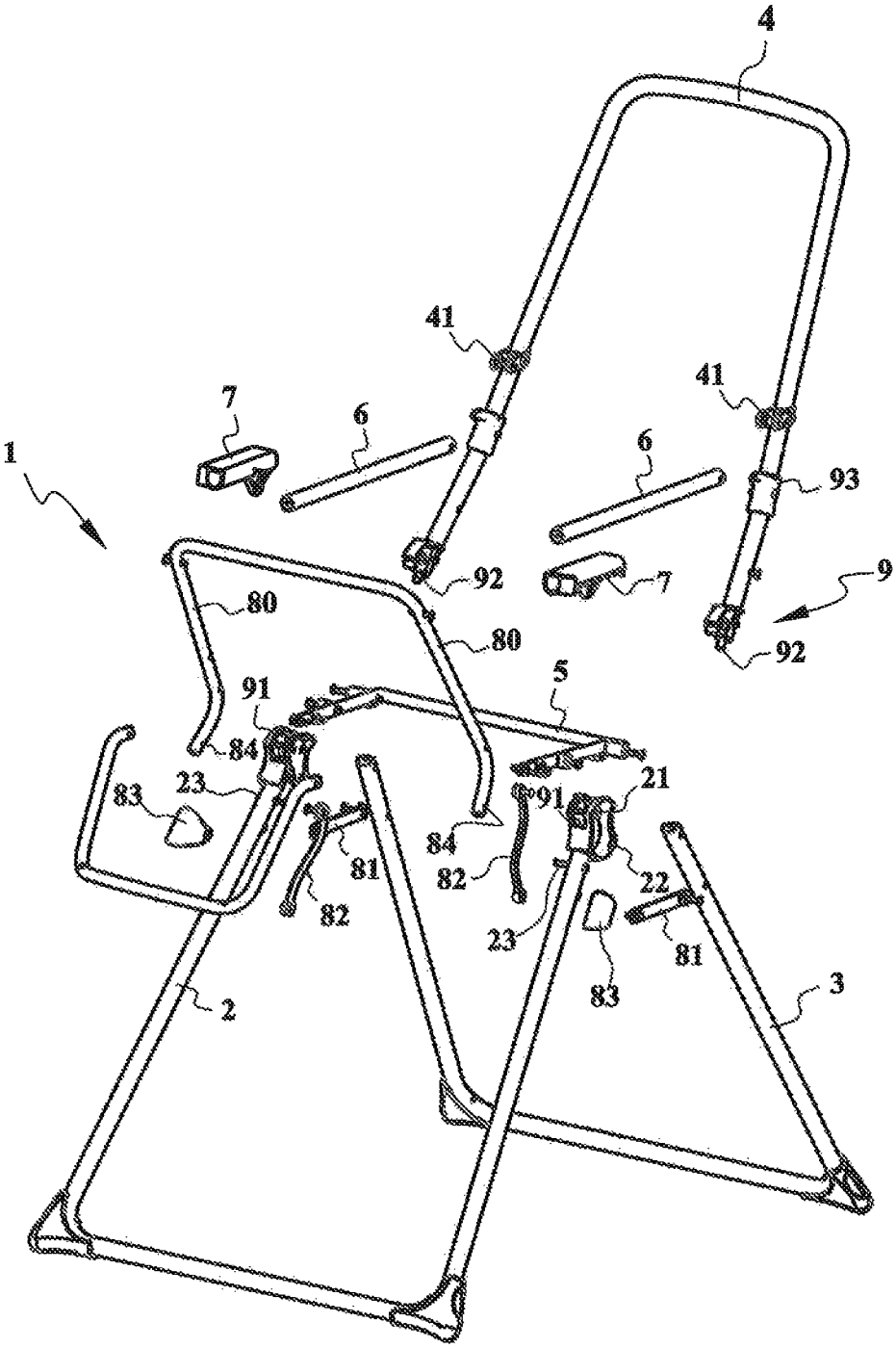
FIG. 2 is a exploded perspective view of the linkage for a foldable high chair according to the present invention.
Figure 3:
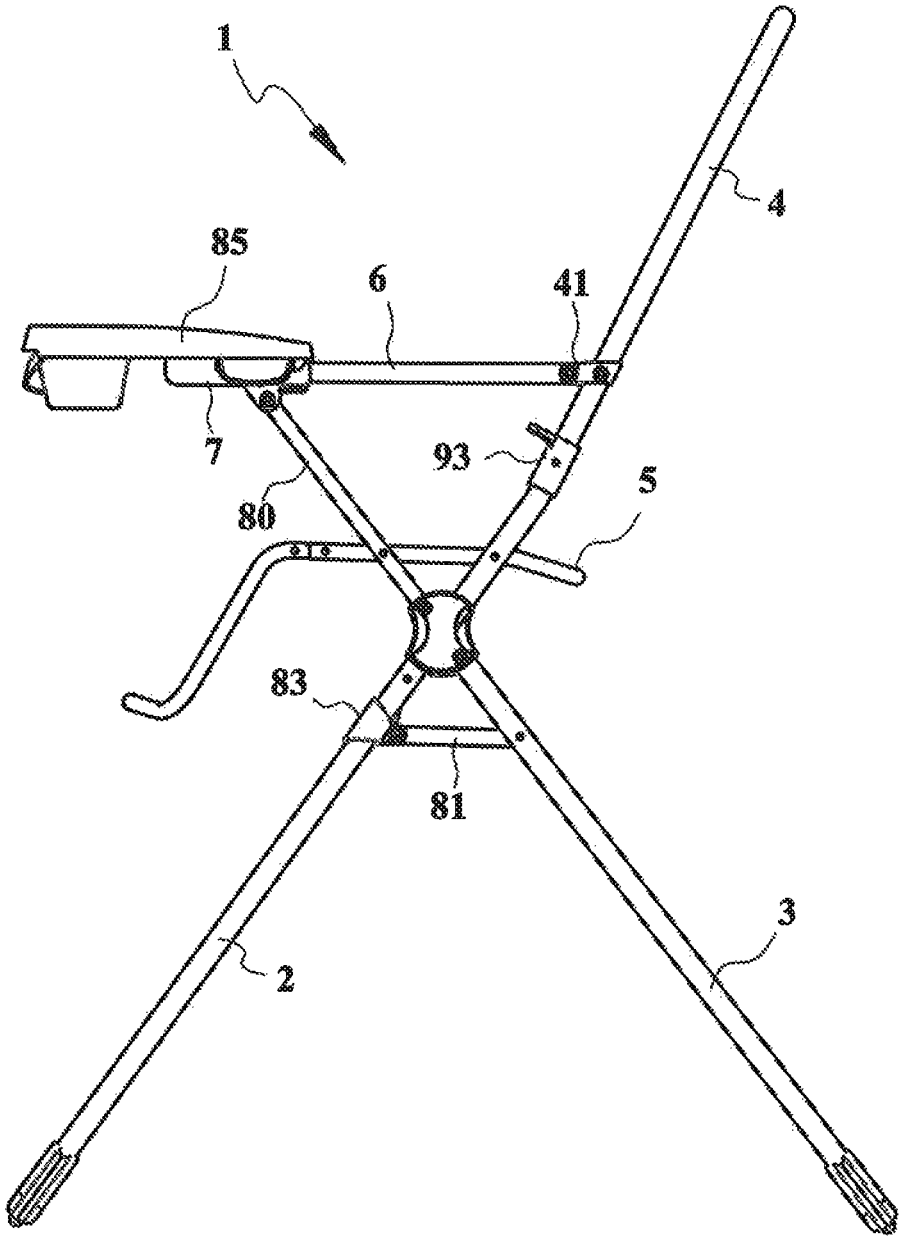
FIG. 3 is a side view of the linkage for a foldable high chair according to the present invention.

Referring to FIGS. 1 to 3, an embodiment of the linkage for a foldable high chair 1 according to the present invention comprises at least a front strut frame 2, a rear strut frame 3, a chair back frame 4, a seat support frame 5, a pair of arm rests 6, a first link 80, a second link 81 and third link 82 assembled by pivot means, such as pins, rivets etc., with each other, and a locking mechanism 9 for keeping the foldable high chair 1 in a use position.

The locking mechanism 9 may either be mounted between the front strut frame 2 and the chair back frame 4 for preventing the chair back frame 4 from rotation relative to the front strut frame 2, or be mounted between the second slidable connectors 7 and the pair of arm rests 6 thereby preventing the second slidable connectors 7 from sliding along the arm rests 6, so as can keep the foldable high chair 1 in the use position. In one embodiment as best shown in FIG. 2, the locking mechanism 9 includes two slots 91 formed on the upper ends of the front strut frame 2, and two spring-biased engaging elements 92 retractably mounted at the lower distal ends of the chair back frame 4. The two spring-biased engaging elements 92 may engage with the two slots 91 so as to prevent the chair back frame 4 from rotation relative to the front strut frame 2. The locking mechanism 9 may further include two release actuator 93 operatively mounted on the chair back frame 4 for disengaging the spring-biased engaging elements 92 from the two slots 91 so as to permit the rotation of the chair back frame 4 relative to the front strut frame 2.

Figure 4:
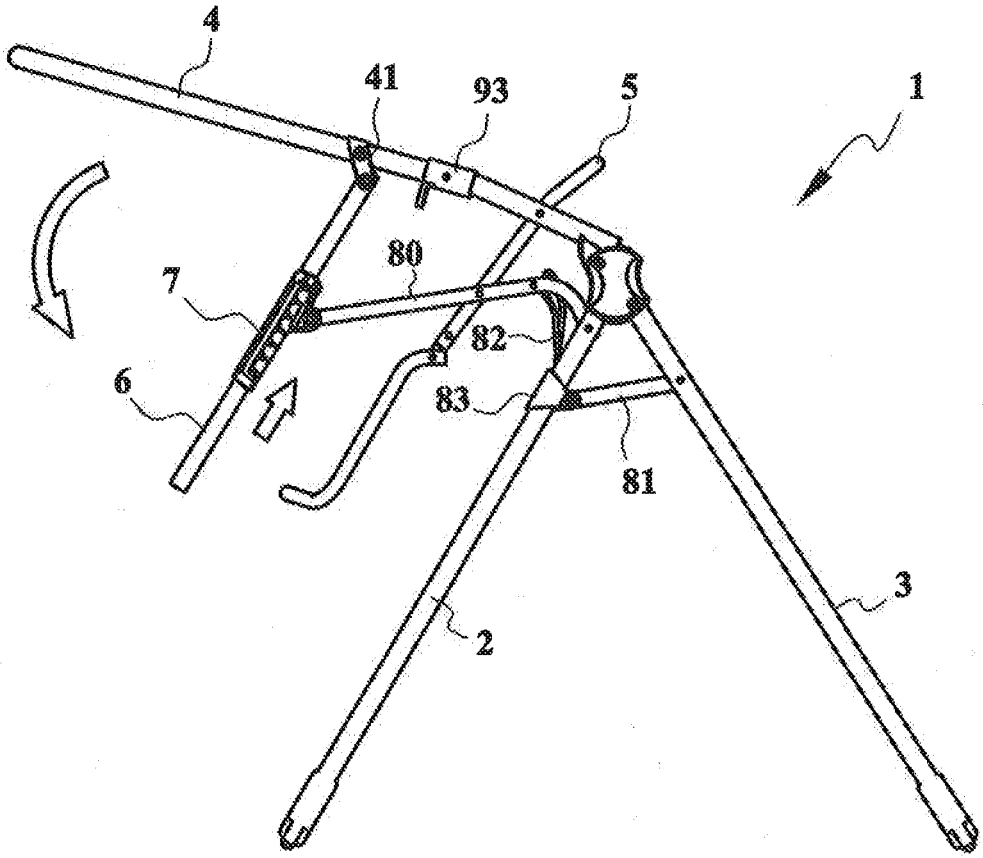
FIG. 4 is a schematically side view showing the initial folding operation of the linkage for a foldable high chair according to the present invention.
Figure 5:
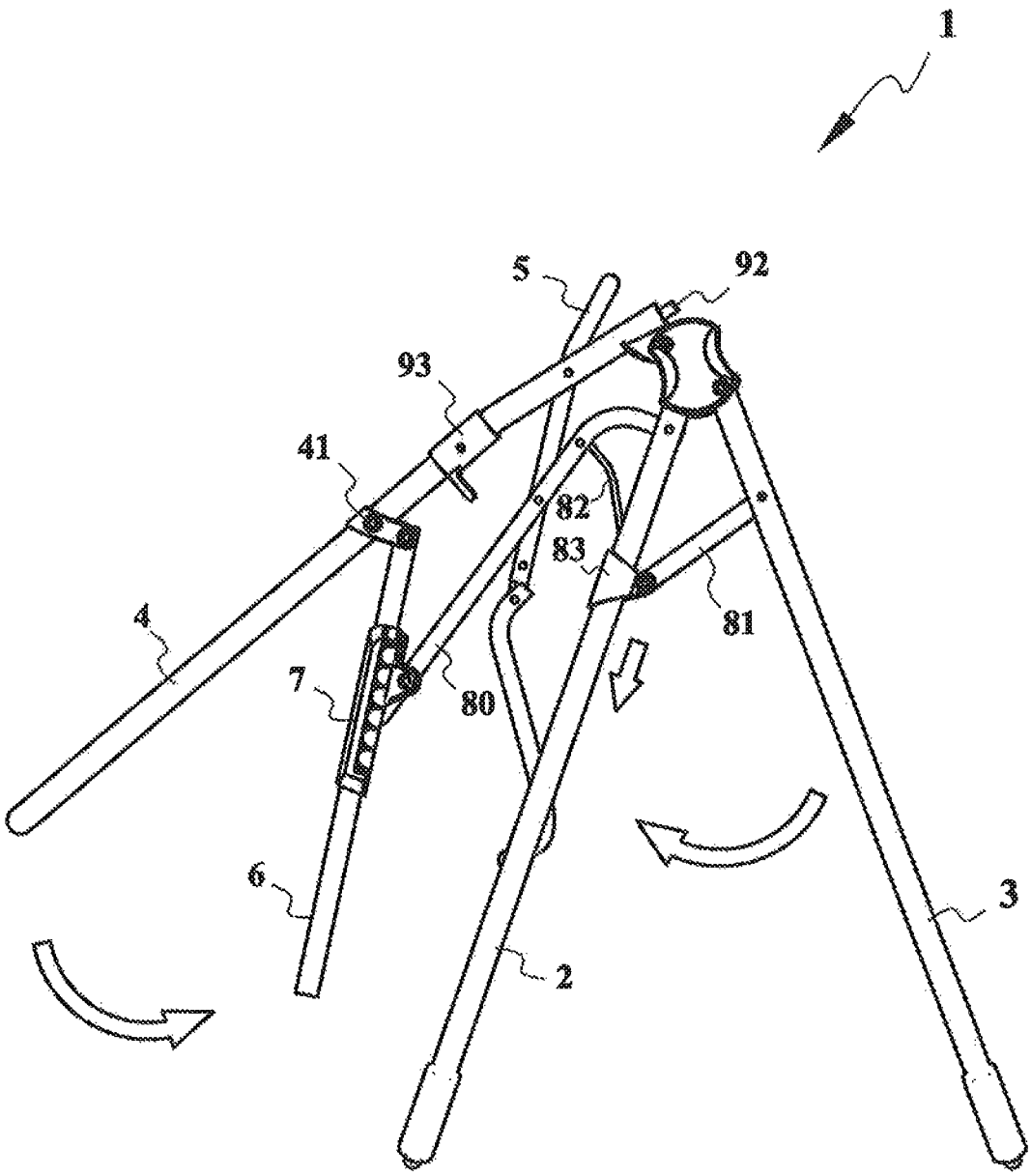
FIG. 5 is a schematically side view showing a further step of the folding operation next to FIG. 4 for the foldable high chair.
Figure 6:
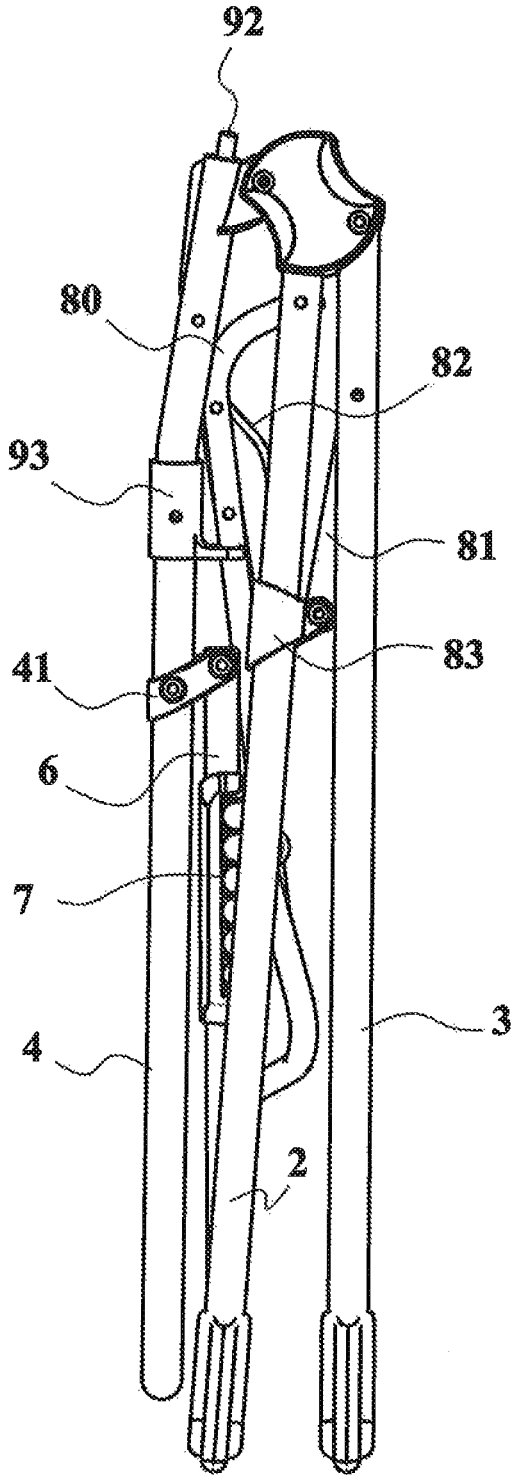
FIG. 6 is a schematically side view showing the foldable high chair has been folded in a folded position.

Referring to FIGS. 4 to 6, the foldable high chair 1 is capable of folding into folded position by rotating the chair back frame 4 forward and downward thereby associating the rear strut frame 3 to close to the front strut frame 2.

The linkage for a foldable high chair 1 is featured by that the front strut frame 2 of the foldable high chair has an upper end provided with a first pivotable portion 21 for pivoting with a chair back frame 4, a second pivotable portion 22 for pivoting with a rear strut frame 3, and a third pivotable portion 23 for pivoting with a first link 80 at the lower ends 84 thereof.

Referring back to FIG. 2, the foldable high chair 1 further includes a first slidable connector 83 sleeved on and slidable along the front strut frame 2, a second link 81 has one end pivoted with the rear strut frame 3, and another end pivoted with the first slidable connector 83, and a third link 82 has an upper end pivoted with the first link 80 and a lower end pivoted with the first slidable connector 83.

In this embodiment, the first pivotable portion 21 and the second pivotable portion 22 may be formed as two lugs extending from the upper end of the front strut frame 2 in different directions.

The seat support frame 5 is pivoted between the chair back frame 4 and the first link 80, and the second slidable connectors 7 are slidably connected to the pair of arm rests 6 and pivoted with the first link 80.

In this embodiment, the chair back frame 4 may be equipped with a pair of lugs 41 for pivoting the arm rests 6, and the two second slidable connectors 7 may sleeve on the pair of arm rests 6 respectively and pivoted with the upper end of the first link 80. When deploying the foldable high chair 1 from its folded position to the use position, the first link 80 can be associated to drive the second slidable connectors 7 to slide toward the front end of the arm rests 6 thereby lifting the arm rests 6 to a horizontal position for normal use.

Preferably, a tray 85 may be detachably mounted on the second slidable connectors 7 so as to slide along the arm rests 6 for putting foods and/or toys thereupon for the occupant.

Referring again to FIGS. 4 to 5, by the described linking arrangement, the seat support frame 5 is capable of driving by the chair back frame 4 and then drives the first slidable connector 83 through the first link 80 and the third link 82, and then the first slidable connector 83 drives the rear strut frame 3 through the second link 81, so as to rotate the rear strut frame 3 to close to the front strut frame 2.

It is said that the foldable high chair 1 according to the present invention can be folded by the steps of unlocking the locking mechanism 9 and then rotating the chair back frame 4 forward and downward.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A linkage for a foldable high chair, comprising at least a front strut frame, a rear strut frame, a chair back frame, a seat support frame, a pair of arm rests, a first link, a second link and third link assembled by pivoting with each other and a locking mechanism capable of keeping the foldable high chair in a use position, wherein the front strut frame has an upper end provided with a first pivotable portion for pivoting with the chair back frame, a second pivotable portion for pivoting with the rear strut frame, and a third pivotable portion for pivoting with the first link, a first slidable connector being sleeved on and capable of sliding along the front strut frame;

the second link has one end pivoted with the rear strut frame, another end pivoted with the first slidable connector;

the third link has an upper end pivoted with the first link, and a lower end pivoted with the first slidable connector;

the seat support frame is pivoted between the chair back frame and the first link; and the linkage further includes two second slidable connectors slidably connected to the pair of arm rests and pivoted with the first link.

2. The linkage of claim 1, wherein the locking mechanism is mounted between the front strut frame and the chair back frame for preventing the chair back frame from rotation relative to the front strut frame, so as to keep the foldable high chair in the use position.

3. The linkage of claim 1, wherein the locking mechanism is mounted between the second slidable connectors and the pair of arm rests, for preventing the second slidable connectors from sliding along the arm rests, so as to keep the foldable high chair in the use position.

4. The linkage of claim 1, wherein the chair back frame is provided with a pair of lugs for pivoting the arm rests.

5. The linkage of claim 1, wherein the two second slidable connectors are sleeved on the pair of arm rests and pivoted with an upper end of the first link.

6. The linkage of claim 1, wherein when the foldable high chair is deploying from a folded position to the use position, the first link is driving the second slidable connectors to slide toward a front end of the arm rests thereby lifting the arm rests to a horizontal position for use.

7. The linkage of claim 1, further comprising a tray detachably mounted on the second slidable connectors and capable of sliding along the arm rests.

8. The linkage of claim 1, wherein the first pivotable portion and the second pivotable portion are two lugs extending from the upper end of the front strut frame in different directions.

9. The linkage of claim 1, wherein the seat support frame is driven by the chair back frame and then drives the first slidable connector through the first link and the third link, and then the first slidable connector drives the rear strut frame through the second link, so as to drive the rear strut frame by the chair back frame to rotate relative to the front strut frame.

10. The linkage of claim 9, wherein the foldable high chair is foldable by unlocking the locking mechanism and then rotating the chair back frame forward and downward.

* * * * *